US005117642A

United States Patent [19]

Nakanishi et al.

[11] Patent Number: 5,117,642

[45] Date of Patent: Jun. 2, 1992

[54] LOW NOISE REFRIGERATOR AND NOISE CONTROL METHOD THEREOF

[75] Inventors: Keiji Nakanishi; Yasuyuki Sekiguchi, both of Osaka, Japan

[73] Assignee: Kabushiki Kaisha Toshiba, Kanagawa, Japan

[21] Appl. No.: 626,705

[22] Filed: Dec. 14, 1990

[30] Foreign Application Priority Data

Dec. 18, 1989 [JP] Japan ..... 1-327784
Dec. 18, 1989 [JP] Japan ..... 1-327785
Dec. 18, 1989 [JP] Japan ..... 1-327787

[51] Int. Cl.[5] ..... F25D 19/00

[52] U.S. Cl. ..... 62/115; 62/296; 181/206; 381/71

[58] Field of Search ..... 381/71, 73.1, 94; 62/296, 115; 417/14; 181/202, 200, 206

[56] References Cited

U.S. PATENT DOCUMENTS 2,043,416 6/1936 Lueg ..... 179/1
4,025,724 5/1977 Davidson, Jr. et al. ..... 381/71
4,153,815 5/1979 Chaplin et al. ..... 381/71

FOREIGN PATENT DOCUMENTS 63-311397 12/1988 Japan .

OTHER PUBLICATIONS

IBM Technical Disclosure Bulletin vol. 31 No. 8 Jan. 1984.

*Primary Examiner*—William E. Wayner
*Attorney, Agent, or Firm*—Foley & Lardner

[57] ABSTRACT

In a low noise refrigerator, a compressor constituting a noise source is arranged within a machine chamber provided with an opening in one location, which chamber has a one-dimensional duct construction in which its cross-sectional dimension is small relative to the wavelength of the noise which is to be reduced. A vibration pick-up is located in the vicinity of the compressor. The vibration pick-up detects compressor vibrations which correlate to the compressor noise of the compressor. There is provided a control circuit that processes the output signal of the vibration pick-up. In the machine chamber, a sound generator is driven by the output signal of the control circuit to generate a control sound, so that the compressor noise which tries to issue from the opening is canceled by the control sound.

29 Claims, 5 Drawing Sheets

LOW NOISE REFRIGERATOR AND NOISE CONTROL METHOD THEREOF

BACKGROUND OF THE INVENTION

1. Field of the Invention

The present invention relates, in general, to a low noise refrigerator equipped with a silencing system adopting a so-called active control method.

2. Description of the Related Art

Recently, attempts have been made to lower the noise produced by the compressor and fan motor of a refrigerator which constitute the principal sources of refrigerator noise. Progress has been made with anti-vibration designs for the refrigerant piping within the machinery chamber that accommodates the compressor. Also, by use of sound absorbing and sound insulating materials or mufflers, reduction of the high frequency components of compressor noise has been achieved to some degree. However, there is a problem that sufficient noise reduction can not be achieved by these conventional techniques in the low frequency noise band in particular.

Therefore, the inventors of the present invention have studied the application of a silencing system adopting a so-called active control method to refrigerators. In an active controlled silencing system, noise is cancelled by actively emitting a controlled sound from, for example a speaker. The noise source is detected by using a microphone such as described in U.S. Pat. No. 2,043,416. Japanese Patent Disclosure (Kokai) No. 63-311397 discloses that at least a section of the sound wave propagation path, where the silencing system is located, is constructed of a special material such as a vibration stopper or vibration absorbent. One example of the application of an active control silencing system to a refrigerator is shown in FIG. 8. The contents of FIG. 8 are presented for explanation, not as a description of the prior art. In FIG. 8, a compressor 20 is arranged in a machine chamber 10 that is located at the lowest part at the back face of the refrigerator. The compressor 20 is the main source of refrigerator noise. The machine chamber 10 has a one-dimensional duct construction, being completely sealed except for a single opening 17 for heat radiation and evaporation of defrosting water. That is, by making the dimensions of the cross-section of the duct sufficiently small in comparison with the wavelength of the compressor noise S that is to be reduced, the compressor noise S in the machine chamber 10 can be made to be a one-dimensional plane-progressive wave. The compressor noise S is detected by a microphone 35 that is arranged in a position within the machine chamber 10 remote from the opening 17. The compressor noise, i.e., the sound M that is detected by the microphone 35 is processed by a control circuit 40 of transfer function G. Circuit 40 is equipped with a finite impulse response filter (hereafter, FIR filter) that for example, directly processes the detected signal in the time domain, before supplying a compressor noise cancellation signal to the speaker 50. The compressor noise that tries to get out from the opening 17 of the machine chamber 10 is canceled by the controlled sound A produced by the speaker 50.

The transfer function G of the control circuit 40 is determined as follows. The detected sound M obtained by the microphone 35 can be represented by equation (1) below, in terms of the noise S emitted from the compressor 20 and the controlled sound A emitted from the silencing speaker 50, using the sound transfer function $G_{SM}$ between the compressor and the microphone and the sound transfer function $G_{AM}$ between the speaker and the microphone.

$$M = S \times G_{SM} + A \times G_{AM} \quad (1)$$

For test purposes, a microphone 55 for evaluation of the silencing effect is provided at the opening 17 of the machine chamber 10. The measured sound R of the evaluation microphone 55 can be expressed by equation (2) below, using the sound transfer function $G_{SR}$ between the compressor and the opening, and the sound transfer function $G_{AR}$ between the speaker and the opening.

$$R = S \times G_{SR} + A \times G_{AR} \quad (2)$$

Since G is the transfer function between the microphone and the speaker, the following equation (3) holds.

$$A = M \times G \quad (3)$$

In order to cancel the compressor noise that tries to issue from the opening 17, the following equation (4) should be hold.

$$R = 0 \quad (4)$$

From above equations (1) to (4), the transfer function G for silencing is expressed by the following equation (5).

$$G = G_{SR}/(G_{SR} \times G_{AM} - G_{SM} \times G_{AR}) \quad (5)$$

If the numerator and the denominator of the equation (5) is divided by $G_{SM}$, the following equation (6) is obtained. $G_{MR}$ is defined by equation (7).

$$G = G_{MR}/(G_{MR} \times G_{AM} - G_{AR}) \quad (6)$$

$$G_{MR} = G_{SR}/G_{SM} \quad (7)$$

By using these equations (6) and (7), even if the compressor noise S is unknown, the transfer function G to make the measured sound R zero can be found by measuring the transfer function ratio $G_{MR}$ between $G_{SR}$ and $G_{SM}$. On this occasion, in the condition in which noise S is generated from the compressor 20, the detected sound may be treated as an input signal and the measured sound R may be treated as a response signal.

If a transfer function G determined as above is supplied to control circuit 40, a controlled sound A corresponding to compressor noise S is generated and the noise S is canceled at the opening 17 of the machine chamber 10.

However, when the compressor noise S is detected by the microphone 35, the following problems occur. First of all, since not only the noise S from the compressor 20 but also the controlled sound A from silencing speaker 50 is picked up by the microphone 35, howling can occur. Therefore, the output of the speaker 50 must be kept fairly low, resulting in an inadequate silencing effect. An echo canceler can be fitted to control circuit 40 to prevent howling, but this raises the cost of the system. Also, if a fan for cooling the compressor 20 is provided in machine chamber 10, the noise generated by the fan will also be picked up by the microphone 35, making the control for silencing more complicated.

Furthermore, there is a risk that the silencing system would react to, for example, an external noise.

SUMMARY OF THE INVENTION

Accordingly, it is an object of the present invention to provide a refrigerator with an active control silencing system wherein howling is avoided.

It is a further object of the present invention to provide a refrigerator having an active control silencing system which is not affected by sound other than compressor noise.

In accordance with the present invention, the foregoing objects are achieved by providing a refrigerator with a silencer system. The refrigerator includes a compressor, a machine chamber, a vibration pick-up, a control circuit and a sound generator. The compressor compresses a refrigerant and constitutes a substantial noise source. The machine chamber accommodates the compressor. The machine chamber is provided with an opening in one location. The chamber has a one-dimensional duct construction in which the cross-sectional dimension of the duct is small relative to the wavelength of the compressor noise to be reduced. The vibration pick-up detects compressor vibrations of the compressor which correlate to the compressor noise. The vibration pick-up is located in the vicinity of the compressor. The control circuit processes an output signal of the pick-up. The sound generator generates a control sound corresponding to the compressor noise. The sound generator is driven by an output signal from the control circuit.

BRIEF DESCRIPTION OF THE DRAWINGS

These and other objects and advantages of this invention will become more apparent from the following detailed description of the presently preferred embodiment of the invention, taken in conjunction with the accompanying drawings of which.

DETAILED DESCRIPTION OF THE PREFERRED EMBODIMENTS

Figure 1:
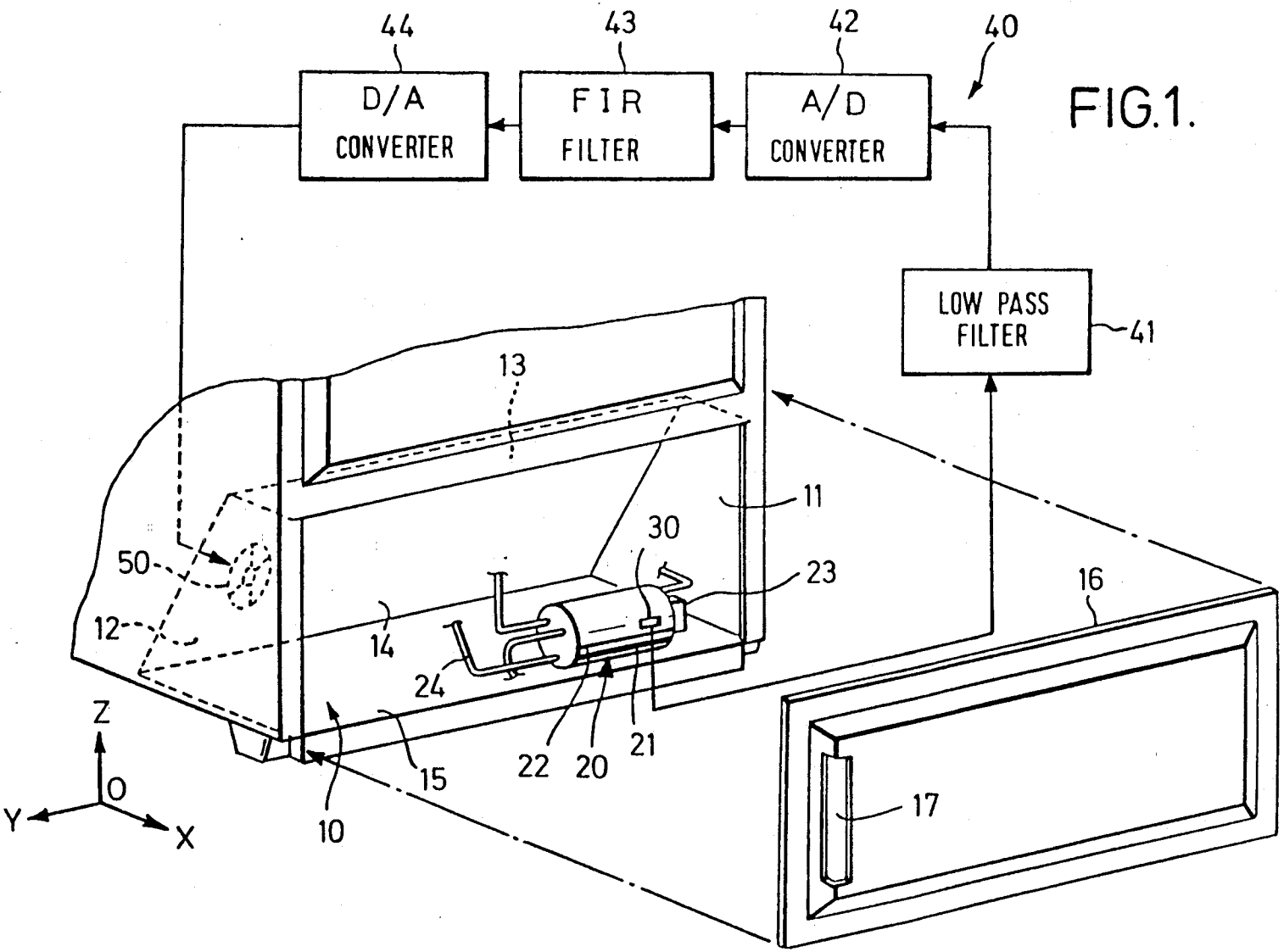
FIG. 1 is an exploded perspective view of the lowest part at the back face of a low noise refrigerator according to a first of the present invention.

The preferred embodiment of the present invention will now be described in more detail with reference to the accompanying drawings. Like reference numerals designate like or corresponding parts throughout the drawings.

In FIG. 1, a compressor 20 is arranged in machine chamber 10 which is positioned at the lowest part of the back face of the refrigerator. The compressor 20 is the main noise source. The machine chamber 10 is closed by means of two side plates 11, 12, a ceiling plate 13, a front inclined plate 14, a bottom plate 15 and a back face cover 16. Thus, the machine chamber 10 is completely closed with the exception of a single opening 17 for heat radiation etc. that is provided at the left end of the cover 16 seen from the back face of the refrigerator. Taking the X axis in the forwards/rearwards direction of the refrigerator, the Y axis in the left/right direction and the Z axis in the vertical direction, the machine chamber 10 has a one-dimensional duct construction in the direction of the Y axis. That is, the cross-sectional dimension in the X-Z plane of the machine chamber 10 is small relative to the wavelength of the compressor noise that is to be reduced. Therefore, the compressor noise becomes a one-dimensional plane-progressive wave in the direction of the Y axis. Specifically, by taking the dimension in the direction of the Y axis (duct length) of the machine chamber 10 as for example 640 mm or 880 mm, and taking the dimensions in the X and Y directions as about 250 mm, the machine chamber 10 can be considered as a one-dimensional duct in the Y direction. Inasmuch as only the Y-direction sound mode is generated at frequencies of less than 800 Hz, emission of high frequency noise of over 800 Hz is prevented by mounting sound absorbent material consisting of elastic tape on the inner wall surface of the machine chamber 10. Therefore, the frequencies to be silenced by the active control silencing system of this embodiment are between 100 Hz and 800 Hz. The compressor 20 is fixed at the right hand end position on the bottom plate 15 as shown in FIG. 1. The compressor 20 is a rotary compressor with a cylindrical body. The right side of the body of the compressor 20 is a motor unit 21, while the left side of the body is the mechanical unit 22. A cluster unit 23 is provided at the end face on the side of the motor unit 21. A suction pipe 24 is connected to the end face on the side of the mechanical unit 22. A vibration pick-up 30 is mounted on the circumferential face of the motor unit 21. The vibration of the compressor 20 is detected by the pick-up 30. The output signal of the vibration pick-up 30 is sent to a control circuit 40. The control circuit 40 is a cascade circuit consisting of a low pass filter 41, an A/D converter 42, an FIR filter 43 and a D/A converter 44. The output signal of the vibration pick-up 30 is processed by the control circuit 40 and is supplied to a speaker 50. The speaker 50 faces the opening 17 and is mounted at the left end of the front inclined plate 14 as shown in FIG. 1. The low pass filter 41 cuts off signals of frequency higher than one half of the sampling frequency of the A/D converter 42, in order to prevent the occurrence of aliasing error. The A/D converter 42 converts the analog signal that arrives through the low pass filter 41 into a digital signal that can be processed by the FIR filter 43. The FIR filter 43 carries out a convolution on the digital input signal, to create the prescribed output signal (convolute integration value). The D/A converter 44 converts the digital signal that is output from the filter 43 to an analog signal, which it then supplies to the speaker 50. If the upper limit of the frequencies to be silenced is 800 Hz as described above, the sampling frequency should be as high as possible and at least 1.4 KHz. When the duct length is 640 mm, a sampling frequency of 6.4 KHz is suitable.

Figure 2:
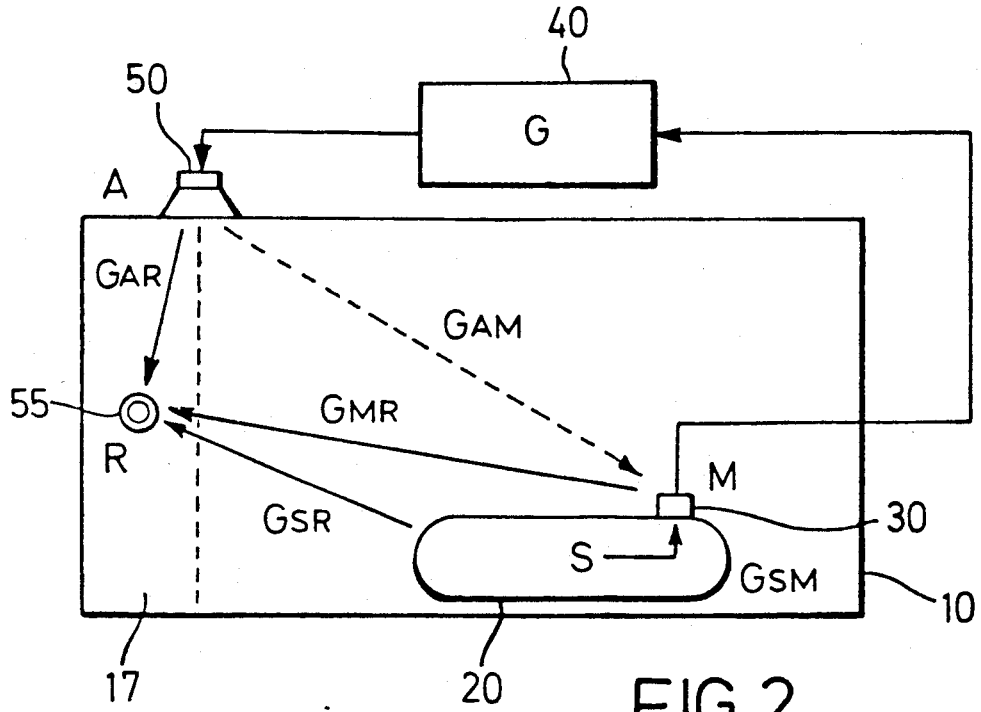
FIG. 2 is a diagram of an active control silencing system in FIG. 1.
Figure 8:
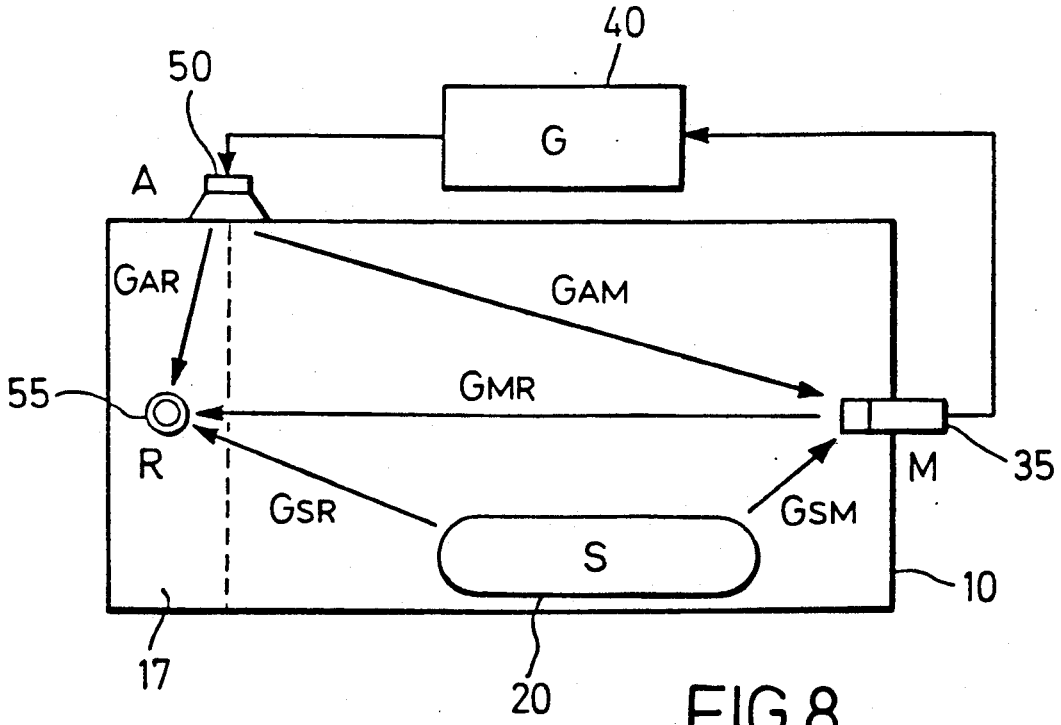
FIG. 8 is a diagram showing a comparative example of an active control silencing system for a low noise refrigerator.
Figure 3:
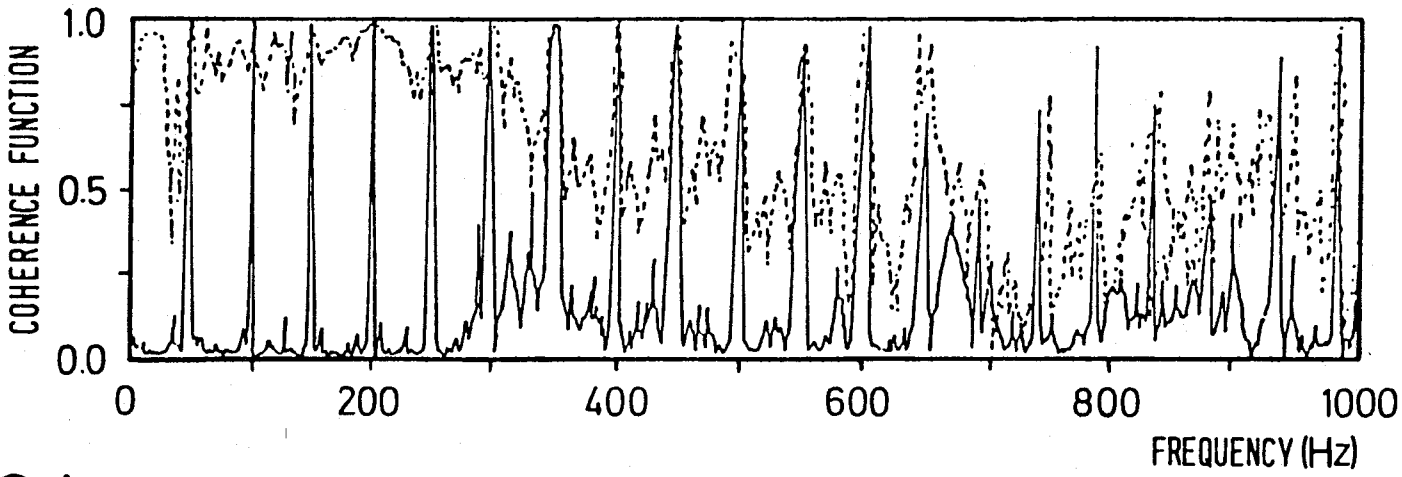
FIG. 3 is a view showing the coherence function between compressor vibration measured at the vibration pick-up mounting position of FIG. 1 and compressor noise.
Figure 4:
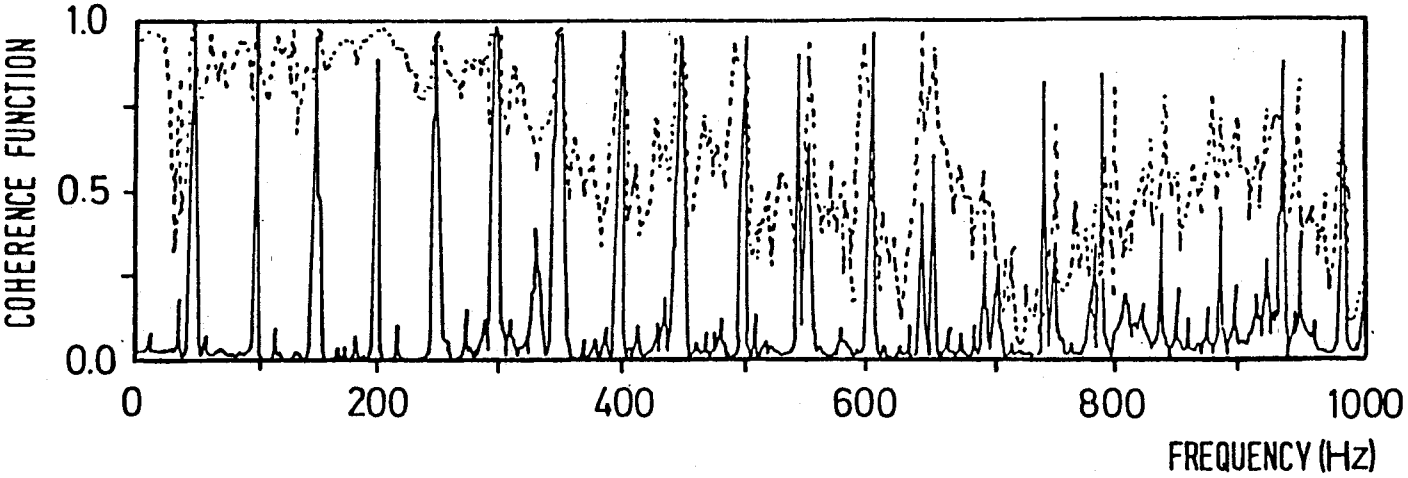
FIG. 4 is a view showing the coherence function between vibration measured at another point on the circumferential surface of the motor of the compressor and compressor noise.

FIG. 2 shows an active control silencing system of a low noise refrigerator according to the embodiment of this invention described above. In FIG. 2, the vibration pick-up 30 is employed instead of the microphone 35 shown in FIG. 8. FIG. 3 and FIG. 4 show the coherence functions between the vibration of the compressor 20 measured at two different points on the motor unit 21 of the compressor 20 and the compressor noise detected by a microphone, respectively. These coherence functions are measured by a two channel FFT (Fast Fourier Transform) analyzer, and are shown by continuous lines in FIG. 3 and FIG. 4. The broken lines in FIG. 3 and FIG. 4 show the coherence functions between the noise which is detected by the noise source detecting microphone and the noise which is detected by the evaluation microphone. As is shown by FIGS. 3 and 4, there is good correlation between the vibration of the compressor 20 and the noise. That is, in constructing a silencing system, measurement of the compressor vibration can be employed instead of detection of the compressor noise S. Furthermore, when a vibration pick-up 30 is employed, the sound transfer function $G_{AM}$ between speaker and pick-up becomes 0, as shown in FIG. 2 (following equation (8)).

$$G_{AM}=0 \tag{8}$$

If the equation (8) is substituted in equation (6), given above, the following equation (9), which is of very simple form, is obtained. $G_{MR}$ is the transfer function ratio of $G_{SR}$ and $G_{SM}$, and is defined by equation (7) given above.

$$G=-G_{MR}/G_{AR} \tag{9}$$

By using these equations (9) and (7), even if the compressor noise S is unknown, the transfer function G of the control circuit 40 in order to make the measured sound R zero at the opening 17 can be found by measuring the transfer function ratio $G_{MR}$. However, the noise that is emitted from the compressor 20 has a discrete spectrum consisting of rotary noise and electromagnetic noise. Therefore, the transfer functions of the speed of revolution of the compressor 20 and harmonics of the speed of revolution and the power source frequency and harmonics of the frequency should be treated as the only effective data. Furthermore, linear interpolation can be effected therebetween. When the transfer function G determined as above is applied to the control circuit, the compressor noise S can be canceled at the machine chamber opening 17 by emitting from the speaker 50 a controlled sound A corresponding to the compressor noise S. A noise reducing effect of for example 5 dB or more is obtained. Furthermore, since the compressor noise S is indirectly measured by the vibration pick-up 30, even if the output of the silencing speaker 50 is raised, there is no risk of the controlled sound A causing howling. In addition, there is no effect from noise other than the compressor noise S, such as fan noise or other external noise. However, the series of operations from the pick-up of compressor vibration by the pick-up 30, processing of the compressor vibration to a silencing signal by the control circuit 40, input of the processed signal to the speaker 50, and the arrival of the controlled sound A from the speaker 50 at opening 17 must be completed before the sound emitted by the compressor 20 reaches the opening 17. In order to make the processing time of the control circuit 40 as long as possible, the compressor 20 is therefore placed as far as possible from the opening 17. Furthermore, the silencing speaker 50 is arranged as close as possible to the opening 17.

Figure 5:
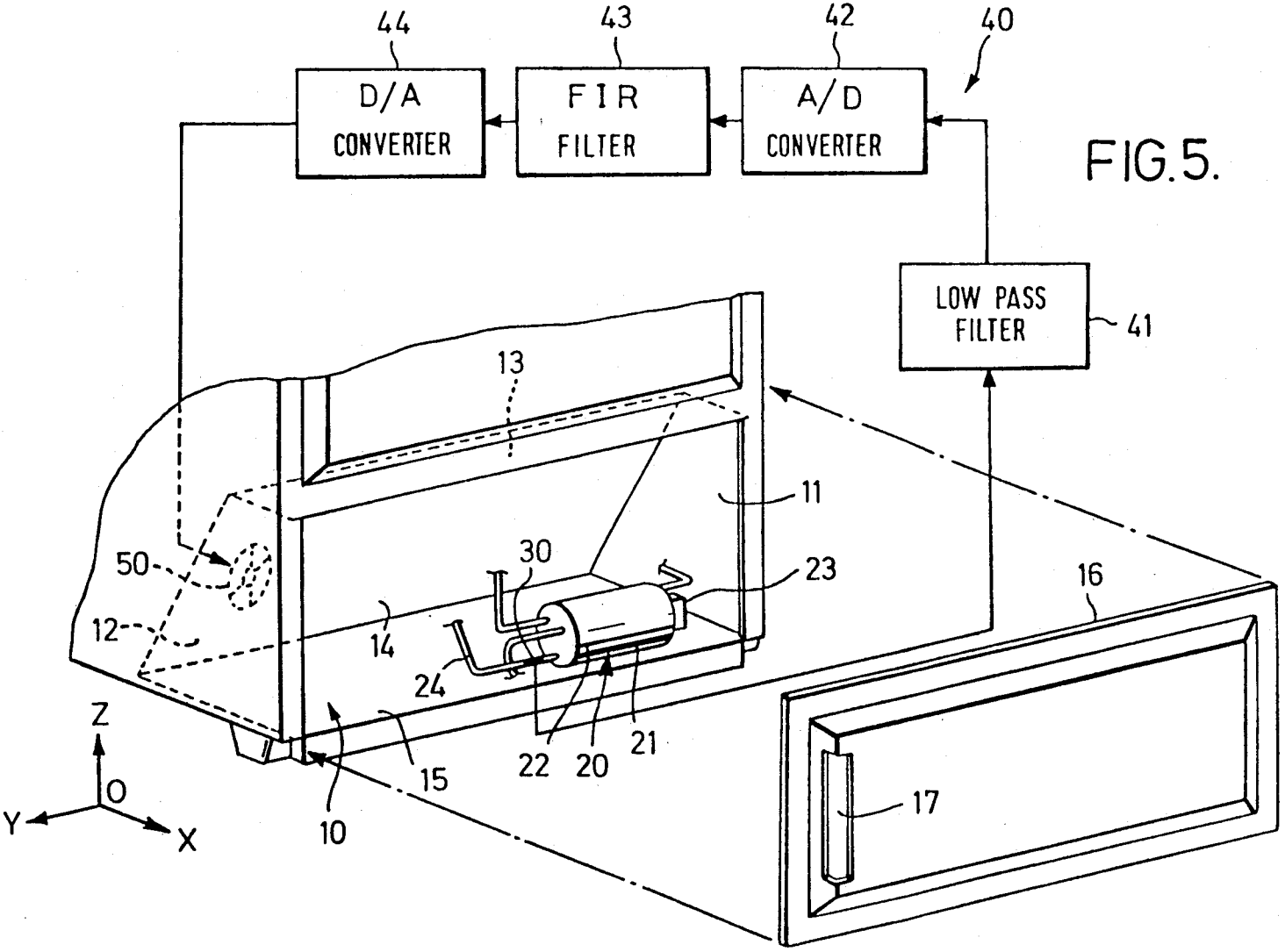
FIG. 5 is an exploded perspective view of the lowest part at the back face of a low noise refrigerator according to a second embodiment of the present invention.
Figure 6:
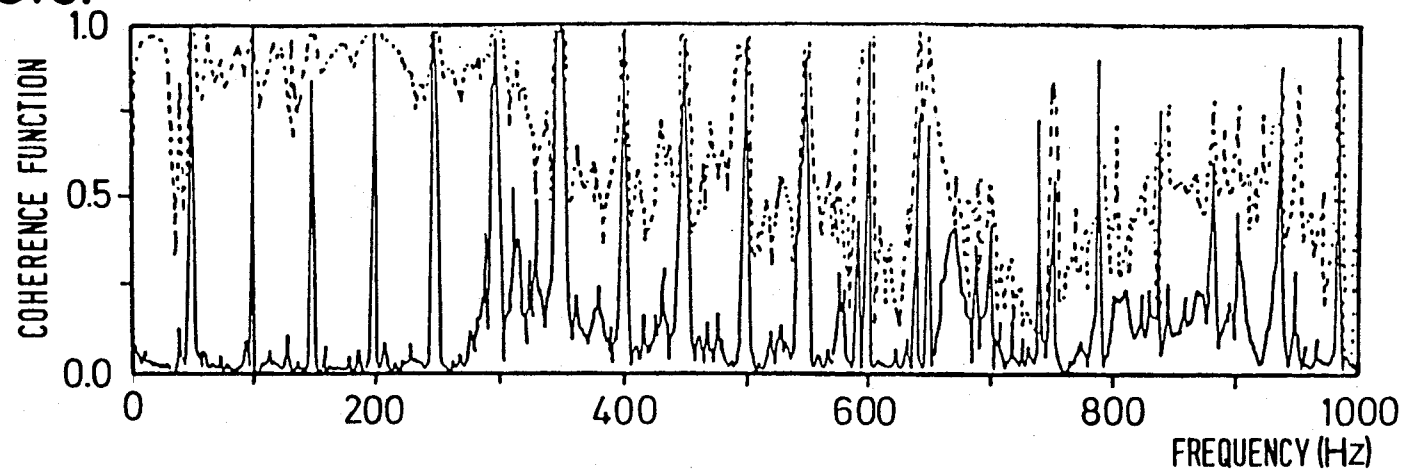
FIG. 6 is a view showing the coherence function between compressor vibration in the X direction measured at the vibration pick-up mounting position of FIG. 5 and compressor noise.
Figure 7:
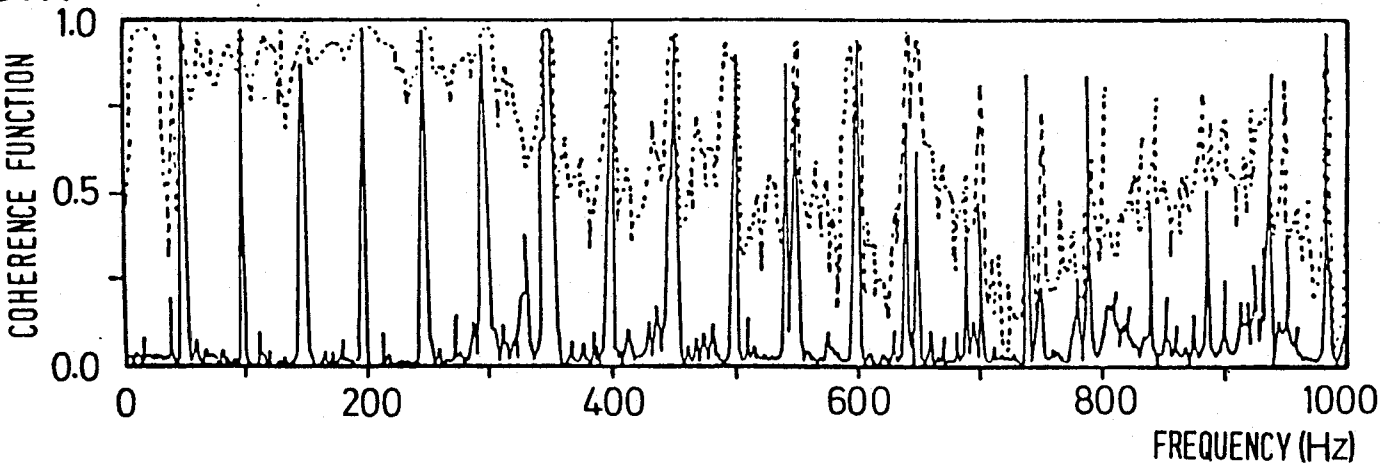
FIG. 7 is a view showing the coherence function between compressor vibration in the Z direction measured as in FIG. 5 at a suction pipe and compressor noise.

A second embodiment of the present invention will now be described with reference to FIGS. 5, 6 and 7. In this embodiment, a vibration pick-up 30 is mounted at the base of the suction pipe 24, as shown in FIG. 5. The vibration of the compressor 20 is detected by the pick-up 30. The vibration pick-up 30 can be fixed to the suction pipe 24 fairly simply, by means of a band or the like. Other elements of the refrigerator having an active control silencing system shown in FIG. 5 are similar to those of the refrigerator shown in FIG. 1. Thus, the same numerals are applied to similar elements and therefore detailed descriptions thereof are not repeated. FIG. 6 shows the coherence function between the vibration in the X direction of the compressor 20 measured on the suction pipe 24 and the compressor noise detected by the evaluation microphone. FIG. 7 shows the coherence function between the vibration in the Z direction of the compressor 20 likewise measured on the suction pipe 24 and the compressor noise detected by the evaluation microphone. These coherence functions are measured by a two channel FFT analyzer. These are shown by continuous lines in FIGS. 6 and 7. The broken lines in FIGS. 6 and 7 show the coherence functions between the noise which is detected by the noise source detecting microphone and the noise which is detected by the evaluation microphone. As shown by FIGS. 6 and 7, there is good correlation between the vibration of the compressor 20 and the noise. In constructing a silencing system, it is clearly understood that measurement of the vibration on the suction pipe 24 can be employed instead of detection of the compressor noise S as shown in FIGS. 6 and 7. Furthermore, since the suction pipe 24 does not reach as high a temperature as the compressor itself, deterioration of the vibration pick-up due to heat can be forestalled, preventing spurious operation of the silencing system.

In these embodiments, real-time control is performed by using an FIR filter 43 in the control circuit 40. It would be possible to perform control with for example a delay of one cycle. As a countermeasure to drift of the silencing transfer function G caused by change with time or solid state differences, so-called adaptive control, in which the transfer function G is automatically suitably altered, can be adopted.

Numerous other modifications and variations of the present invention are possible in light of the above teachings. It is therefore to be understood that, within the scope of the appended claims, the present invention can be practiced in a manner other than as specifically described herein.

What is claimed is:

1. A refrigerator having a silencer system comprising:

a compressor for compressing a refrigerant, the compressor constituting a substantial noise source;

a machine chamber for accommodating said compressor, wherein the machine chamber is provided with an opening in one location, the machine chamber having a one-dimensional duct construction in which a cross-sectional dimension of the duct is small relative to the wavelength of said compressor noise to be reduced;

a vibration pick-up for detecting compressor vibrations of said compressor, wherein the compressor vibrations are representative of said compressor noise, the vibration pick-up being located in the vicinity of said compressor;

a control circuit for processing an output signal of said pick-up; and a sound generator for generating a control sound corresponding to said compressor noise, wherein the sound generator is driven by an output signal from said control circuit.

2. A refrigerator as recited in claim 1, wherein said machine chamber is located substantially at the lowest part at the back face of said refrigerator.

3. A refrigerator as recited in claim 1, wherein an elastic tape is mounted to the inner wall surface of said machine chamber.

4. A refrigerator as recited in claim 1, wherein said machine chamber has a duct length of approximately 640 mm.

5. A refrigerator as recited in claim 1, wherein said machine chamber has a duct length of approximately 880 mm.

6. A refrigerator as recited in claim 1, wherein the frequencies to be silenced are between 100 Hz and 800 Hz.

7. A refrigerator as recited in claim 1, wherein said control circuit is equipped with a finite impulse response filter for processing a signal in the time domain.

8. A refrigerator as recited in claim 1, wherein said control circuit has a transfer function G, whereby the transfer function G is determined by the following equations:

$$G = -G_{MR}/G_{AR}$$

$$G_{MR} = G_{SR}/G_{SM}$$

where $G_{AR}$ is a sound transfer function between said sound generator and said opening, $G_{SR}$ is a sound transfer function between said compressor and said opening, $G_{SM}$ is a sound transfer function between said compressor and said pick-up.

9. A refrigerator as recited in claim 1, wherein said compressor is arranged substantially at the farthest position from said opening within said machine chamber.

10. A refrigerator as recited in claim 1, wherein said sound generator is provided in said machine chamber close to said opening.

11. A refrigerator as recited in claim 9, wherein said sound generator is provided in said machine chamber close to said opening.

12. A refrigerator as recited in claim 1, wherein said sound generator is a speaker.

13. A refrigerator having a silencer system comprising:

a compressor for compressing a refrigerant, the compressor constituting a substantial noise source;

a machine chamber for accommodating said compressor, wherein the machine chamber is provided with an opening in one location, the machine chamber having a one-dimensional duct construction in which a cross-sectional dimension of the duct is small relative to the wavelength of said compressor noise to be reduced;

a vibration pick-up for detecting compressor vibrations of said compressor, wherein the compressor vibrations are representative of said compressor noise, the vibration pick-up is mounted on said compressor;

a control circuit for processing an output signal of said pick-up; and a sound generator for generating a control sound corresponding to said compressor noise, wherein the sound generator is driven by an output signal from said control circuit.

14. A refrigerator as recited in claim 13, wherein said machine chamber is located substantially at the lowest part at the back face of said refrigerator.

15. A refrigerator as recited in claim 13, wherein said machine chamber having a duct length of approximately 640 mm.

16. A refrigerator as recited in claim 13, wherein said machine chamber having a duct length of approximately 880 mm.

17. A refrigerator as recited in claim 13, wherein the frequencies to be silenced are between 100 Hz and 800 Hz.

18. A refrigerator as recited in claim 13, wherein said control circuit is equipped with a finite impulse response filter for processing a signal directly in the time domain.

19. A refrigerator as recited in claim 13, wherein said control circuit has a transfer function G, whereby the transfer function G is determined by the following equations:

$$G = -G_{MR}/G_{AR}$$

$$G_{MR} = G_{SR}/G_{SM}$$

where $G_{AR}$ is a sound transfer function between said sound generator and said opening, $G_{SR}$ is a sound transfer function between said compressor and said opening, $G_{SM}$ is a sound transfer function between said compressor and said pick-up.

20. A refrigerator as recited in claim 13, wherein said compressor is arranged substantially at the farthest position from said opening within said machine chamber.

21. A refrigerator as recited in claim 13, wherein said sound generator is provided in said machine chamber close to said opening.

22. A refrigerator as recited in claim 20, wherein said sound generator is provided in said machine chamber close to said opening.

23. A refrigerator as recited in claim 13, wherein said sound generator is a speaker.

24. A refrigerator having a silencer system comprising:

a compressor for compressing a refrigerant, the compressor constitutes a noise source substantially;

a suction pipe for introducing the refrigerant to said compressor, wherein the suction pipe is connected to said compressor;

a machine chamber for accommodating said compressor, wherein the machine chamber is provided with an opening in one location, the machine chamber having a one-dimensional duct construction in which a cross-sectional dimension of the duct is small relative to the wavelength of said compressor noise to be reduced;

a vibration pick-up for detecting compressor vibrations of said compressor, wherein the compressor vibrations are representative of said compressor noise, the vibration pick-up is mounted on said suction pipe;

a control circuit for processing an output signal of said pick-up; and a sound generator for generating a control sound corresponding to said compressor noise, wherein the sound generator is driven by an output signal from said control circuit.

25. A refrigerator as recited in claim 24, wherein said pick-up is mounted at the base portion of said suction pipe.

26. A refrigerator as recited in claim 24, wherein said compressor is arranged substantially at the farthest position from said opening within said machine chamber.

27. A refrigerator as recited in claim 24, wherein said sound generator is provided in said machine chamber close to said opening.

28. A method for noise controlling a refrigerator equipped with a vibration pick-up located in the vicinity of a compressor and a sound generator provided in a machine chamber of the refrigerator, the machine chamber being provided with an opening in one location and having a one-dimensional duct construction in which a cross-sectional dimension of the duct is sufficiently small relative to the wavelength of a compressor noise to be reduced, the method including the steps of:

detecting vibrations of the compressor by said vibration pick-up, said vibrations representing the noise generated from said compressor;

processing an output signal of said vibration pick-up in the time domain by a finite impulse response filter for determining amplitude and phase of a control sound to be generated in response to said compressor noise; and driving said sound generator to generate said control sound for canceling said compressor noise by said interference action.

29. A method for reducing compressor noise of a refrigerator equipped with a compressor, located in a machine chamber with an opening on one side, comprising the steps of:

providing said machine chamber with one dimensional duct construction in which a cross-sectional dimension of the duct is sufficiently small relative to the wavelength of said compressor noise to be reduced;

detecting vibrations of said compressor with a vibration pick-up located in the vicinity of said compressor, said vibrations corresponding to said compressor noise;

processing an output signal of said vibration pick-up in the time domain by a finite impulse response filter for determining amplitude and phase of a control sound to be generated in response to said compressor noise; and driving a sound generator, located in said machine chamber, to generate said controlled sound for canceling said compressor noise by sound interference action.

* * * * *